US011390997B2

(12) United States Patent
Oishi et al.

(10) Patent No.: US 11,390,997 B2
(45) Date of Patent: Jul. 19, 2022

(54) TITANIUM OXIDE COMPOSITE FIBERS AND METHOD FOR PRODUCING SAME

(71) Applicant: NIPPON PAPER INDUSTRIES CO., LTD., Tokyo (JP)

(72) Inventors: Masatoshi Oishi, Tokyo (JP); Koji Ninagawa, Tokyo (JP); Toru Nakatani, Tokyo (JP); Dai Nagahara, Tokyo (JP); Shisei Goto, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 177 days.

(21) Appl. No.: 16/760,354

(22) PCT Filed: Oct. 5, 2018

(86) PCT No.: PCT/JP2018/037435
§ 371 (c)(1),
(2) Date: Apr. 29, 2020

(87) PCT Pub. No.: WO2019/087694
PCT Pub. Date: May 9, 2019

(65) Prior Publication Data

US 2021/0180254 A1 Jun. 17, 2021

(30) Foreign Application Priority Data

Oct. 31, 2017 (JP) ..... 2017-211125

(51) Int. Cl.

| | |
|---|---|
| ***D21H 11/00*** | (2006.01) |
| ***D21H 17/00*** | (2006.01) |
| ***D01F 9/08*** | (2006.01) |
| ***D21H 17/66*** | (2006.01) |
| ***D21H 17/67*** | (2006.01) |
| ***D21H 19/24*** | (2006.01) |
| ***D21H 21/16*** | (2006.01) |
| ***D21H 21/28*** | (2006.01) |
| ***D21H 23/04*** | (2006.01) |

(52) U.S. Cl.
CPC ..... *D21H 17/73* (2013.01); *D01F 9/08* (2013.01); *D21H 11/00* (2013.01); *D21H 17/66* (2013.01); *D21H 17/675* (2013.01); *D21H 19/24* (2013.01); *D21H 21/16* (2013.01); *D21H 21/285* (2013.01); *D21H 23/04* (2013.01)

(58) Field of Classification Search
CPC .... D21H 21/285; D21H 17/675; D21H 17/66; D21H 15/12; D21H 17/73; D21H 15/10; D21H 19/24; D21H 21/16; D21H 11/00; D21H 23/04; D21H 17/74; D06M 11/46
USPC ..... 162/135
See application file for complete search history.

(56) References Cited

U.S. PATENT DOCUMENTS

| | | | |
|---|---|---|---|
| 2002/0160910 | A1 | 10/2002 | Sanbayashi |
| 2007/0128434 | A1 | 6/2007 | Motoda |
| 2015/0240415 | A1 | 8/2015 | Haggquist |
| 2017/0107668 | A1 | 4/2017 | Fukuoka |
| 2017/0113945 | A1 | 4/2017 | Fukuoka |
| 2017/0211226 | A1 | 7/2017 | Ozawa |
| 2019/0249359 | A1 | 8/2019 | Haggquist |

FOREIGN PATENT DOCUMENTS

| | | |
|---|---|---|
| CN | 1824885 | 8/2006 |
| CN | 107190558 | 9/2017 |
| EP | 0997575 | 5/2000 |
| EP | 3348709 | 7/2018 |
| JP | 11-81127 | 3/1999 |
| JP | 11-81128 | 3/1999 |
| JP | 2002-161009 | 6/2002 |
| JP | 2002-266234 | 9/2002 |
| JP | 2003-201668 | 7/2003 |
| JP | 2005-054313 | 3/2005 |
| JP | 2006-341250 | 12/2006 |
| JP | 2007-204882 | 8/2007 |
| JP | 2008-002007 | 1/2008 |
| JP | 2010-076277 | 4/2010 |
| JP | 2011-094252 | 5/2011 |
| JP | 2015-199655 | 11/2015 |
| JP | 2017-512915 | 5/2017 |
| WO | 2016/013484 | 1/2016 |
| WO | 2017/043585 | 3/2017 |

OTHER PUBLICATIONS

Extended European Search Report, EP Patent Application No. 18874504.6, dated Aug. 17, 2020, 6 pages.
Office Action for JP Patent Application No. 2019-512836, dated Jul. 16, 2019, 10 pages.
Office Action for JP Patent Application No. 2017-211125, dated Aug. 7, 2018, 9 pages.
International Preliminary Report on Patentability for PCT/JP2018/037435, dated May 5, 2020, 9 pages.
International Search Report for PCT/JP2018/037435, dated Nov. 20, 2018, 2 pages.

*Primary Examiner* — Mark Halpern
(74) *Attorney, Agent, or Firm* — Casimir Jones, SC; Robert A. Goetz

(57) ABSTRACT

The present invention provides a titanium oxide composite fiber in which titanium oxide is efficiently fixed in fiber, and a method for producing the titanium oxide composite fiber. A composite fiber of the present invention includes: fiber; titanium oxide; and an inorganic binder, at least part of the inorganic binder containing at least one inorganic compound selected from (i) an inorganic salt containing at least one of: at least one metal selected from magnesium, barium, aluminum, copper, iron, and zinc; and silicic acid and (ii) metal particles containing the at least one metal, the titanium oxide being firmly fixed to the fiber via the inorganic binder.

17 Claims, 3 Drawing Sheets

(a)

(b)

TITANIUM OXIDE COMPOSITE FIBERS AND METHOD FOR PRODUCING SAME

TECHNICAL FIELD

This application is a 371 of PCT/JP2018/037435 filed 5 Oct. 2018.

The present invention relates to a titanium oxide composite fiber, a method for producing the titanium oxide composite fiber, a base sheet for melamine decorative paper containing the titanium oxide composite fiber, and a method for producing the base sheet.

BACKGROUND ART

Causing an inorganic binder to adhere to the surface of fiber allows the fiber to exhibit various properties. There has been under development a method of synthesizing an inorganic substance in the presence of fiber to produce a composite of an inorganic binder and fiber. Patent Literature 1, for example, discloses an inorganic binder composite fiber of calcium carbonate and lyocell fiber or polyolefin fiber.

CITATION LIST

Patent Literature

[Patent Literature 1]

Japanese Patent Application Publication, Tokukai, No. 2015-199655 (Publication Date: Nov. 12, 2015)

SUMMARY OF INVENTION

Technical Problem

It is known that titanium oxide has a particularly high refractive index among white pigments and exhibits a high level of whiteness and a high level of hiding power when internally added in fiber. In a case of internally adding titanium oxide in fiber, a possible technique generally employed to increase the fixation ratio of the titanium oxide is to use aluminum sulfate, cationic polyacrylamide, or the like as a fixing agent for increasing the fixation ratio. However, there is a demand for further improvement of the fixation ratio of titanium oxide in fiber.

In view of that, an aspect of the present invention has an object of providing a titanium oxide composite fiber in which titanium oxide is efficiently fixed in fiber without use of a fixing agent, and a method for producing the titanium oxide composite fiber.

Solution to Problem

Through diligent study of the above problem, the inventor of the present invention discovered that the problem is solved by a titanium oxide composite fiber including titanium oxide and fiber that are firmly fixed to each other via an inorganic binder. As a result, the inventor has completed the present invention.

Specifically, a titanium oxide composite fiber in accordance with an aspect of the present invention is a titanium oxide composite fiber, including: fiber; titanium oxide; and an inorganic binder, at least part of the inorganic binder containing at least one inorganic compound selected from (i) an inorganic salt containing at least one of: at least one metal selected from magnesium, barium, aluminum, copper, iron, and zinc; and silicic acid and (ii) metal particles containing the at least one metal, the inorganic binder being firmly fixed to the fiber, the titanium oxide being firmly fixed to the inorganic binder so that the titanium oxide is firmly fixed to the fiber via the inorganic binder.

Further, a method for producing a titanium oxide composite fiber in accordance with an aspect of the present invention includes the steps of: forming slurry by suspending fiber in an alkaline aqueous solution; adding titanium oxide to the slurry; and generating the titanium oxide composite fiber by synthesizing an inorganic binder in the slurry to which the titanium oxide has been added.

Advantageous Effects of Invention

An aspect of the present invention advantageously provides a titanium oxide composite fiber in which titanium oxide is efficiently fixed in fiber.

DESCRIPTION OF EMBODIMENTS

Figure 1:
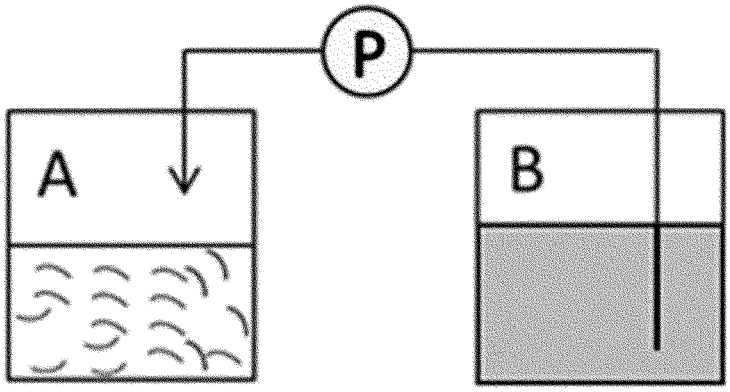
FIG. 1 is a view schematically illustrating a configuration of a reactor which was used in Examples to synthesize a composite fiber from titanium oxide, hydrotalcite, and cellulose fiber.

The following description will discuss embodiments of the present invention in detail. Note, however, that the present invention is not limited to those embodiments, and can be made in an aspect obtained by variously altering the embodiments within the described scope. Note that numerical expressions such as "A to B" herein mean "not less than A and not more than B" unless otherwise stated.

[Titanium Oxide Composite Fiber]

A titanium oxide composite fiber in accordance with an aspect of the present invention includes: fiber; titanium oxide; and an inorganic binder, the inorganic binder, which is in, for example, solid form, being firmly fixed to the fiber, the titanium oxide being firmly fixed to the inorganic binder so that the titanium oxide is firmly fixed to the fiber via the inorganic binder.

In contrast to a titanium oxide composite fiber that include fiber, titanium oxide, and an inorganic binder which are simply present in a mixed manner, a titanium oxide composite fiber in accordance with an aspect of the present invention includes fiber, titanium oxide, and an inorganic binder in such a manner that the fiber and the titanium oxide are firmly fixed to and complexed with each other via the inorganic binder. This makes it less likely for the titanium oxide to fall off the fiber. It is thus possible to produce a composite fiber that is high in yield of titanium oxide and exhibits high levels of whiteness and hiding power.

A strength of a bond of the fiber to the inorganic binder and the titanium oxide in the composite fiber can be evaluated, for example, by ash yield (%). For example, in a case where the composite fiber is in the form of a sheet, the strength of the bond can be evaluated based on a numerical value of (ash content of sheet÷ ash content of composite fiber before disintegration)×100. Specifically, after disintegration for 5 minutes with use of a standard disintegrator defined in JIS P 8220-1: 2012 while adjusting a solid concentration to 0.2% by dispersing the composite fiber in water, an ash yield of a sheet obtained by using 150-mesh wires according to JIS P 8222: 1998 can be used for evaluation.

In a preferable aspect, the ash yield is not less than 80% by mass and, in a more preferable aspect, the ash yield is not less than 90% by mass. That is, unlike in a case in which titanium oxide is simply internally added in fiber or a case in which titanium oxide and an inorganic binder are simply mixed with fiber, causing the inorganic binder and the titanium oxide to be complexed with the fiber enables providing a composite fiber having the following advantage. Namely, in an aspect in which, for example, the composite fiber is in the form of a sheet, the inorganic binder and the titanium oxide are not only more likely to remain in the composite fiber but also uniformly dispersed without aggregation.

According to an aspect of the present invention, it is preferable that not less than 15% of the fiber surface in the titanium oxide composite fiber is covered with the inorganic binder. In a case where the fiber surface is covered with the inorganic binder at such an area ratio, the titanium oxide is able to remain in the fiber at a high proportion and thus be bonded to the fiber efficiently. This allows the titanium oxide to exhibit more remarkable levels of whiteness and hiding power. Further, a coverage (area ratio) of the fiber by the inorganic binder in the composite fiber is more preferably not less than 50%, and even more preferably not less than 80%. According to a method for synthesizing an inorganic binder in a solution containing fiber and titanium oxide in accordance with the present invention, it is possible to suitably produce a composite fiber having a coverage of not less than 90%, or even not less than 95%. An upper limit of the coverage can be set as appropriate in accordance with the purpose of use and is, for example, 100%, 90%, 80%. Further, it has been revealed from a result of electron microscopy that in a composite fiber in accordance with an aspect of the present invention, the inorganic binder is generated on an outer surface of the fiber.

According to an aspect of the present invention, a total ash content (%) of the titanium oxide composite fiber is preferably not less than 20% and not more than 80%, more preferably not less than 30% and not more than 60%. The total ash content (%) of the composite fiber can be calculated as follows: that is, slurry (of 3 g on a solid content basis) of the composite fiber is subjected to suction filtration with use of filter paper; then a residue is dried in an oven (at 105° C. for 2 hours); then an organic component is further burned at 525° C.; and then the total ash content is calculated based on a difference between masses measured before and after the burning. By forming such a composite fiber into a sheet, it is possible to manufacture a composite fiber sheet having a high ash content.

According to an aspect of the present invention, sheets of various basis weights can be suitably employed as the sheet. Examples of such a sheet include a sheet having a basis weight of, for example, not less than 30 g/m$^2$ and not more than 600 g/m$^2$, preferably not less than 50 g/m$^2$ and not more than 150 g/m$^2$.

[Inorganic Binder]

An inorganic binder included in a titanium oxide composite fiber in accordance with an aspect of the present invention may be any inorganic binder provided that the inorganic binder can be firmly fixed to the fiber and the titanium oxide, and is preferably an inorganic binder that is insoluble or poorly soluble in water. The inorganic binder is preferably insoluble or poorly soluble in water, because synthesis of the inorganic binder may be carried out in a water system, and the composite fiber may be used in a water system.

The inorganic binder is a solid inorganic compound and can be, for example, a metal compound. The metal compound is what is called an "inorganic salt", which is composed of metal cation (e.g., $Na^+$, $Ca^{2+}$, $Mg^{2+}$, $Al^{3+}$, $Ba^{2+}$, or the like) and anion (e.g., $O^{2-}$, $OH^-$, $CO_3^{2-}$, $PO_4^{3-}$, $SO_4^{2-}$, $NO_3^-$, $Si_2O_3^{2-}$, $SiO_3^{2-}$, $Cl^-$, $F^-$, $S^{2-}$, or the like) which are bound together by an ionic bond. Specific examples of the inorganic binder include a compound containing at least one metal selected from the group consisting of gold, silver, copper, platinum, iron, zinc, and aluminum. The inorganic binder can also be magnesium carbonate, barium carbonate, aluminum hydroxide, calcium hydroxide, barium sulfate, magnesium hydroxide, zinc hydroxide, calcium phosphate, zinc oxide, zinc stearate, silica composed of sodium silicate and mineral acid (white carbon, silica/calcium carbonate complex, silica/titanium dioxide complex), calcium sulfate, zeolite, and/or hydrotalcite. The above exemplified inorganic binders can be used alone or two or more types of those inorganic binders can be used in combination, provided that those inorganic binders do not disturb synthetic reactions in the solution containing fiber.

In an embodiment of the present invention, at least part of the inorganic binder contains (i) a metal salt containing at least one selected from the group consisting of silicic acid, magnesium, barium, aluminum, copper, iron, and zinc or (ii) metal particles. In terms of having a high capability to bond to titanium oxide, barium sulfate and hydrotalcite are more preferable, and hydrotalcite is particularly preferable.

Generally, hydrotalcite is represented by a formula: $[M^{2+}_{1-x}M^{3+}_x(OH)_2][A^{n-}_{x/n}.mH_2O]$ (where $M^{2+}$ represents a bivalent metal ion, $M^{3+}$ represents a trivalent metal ion, $A^{n-}_{x/n}$ represents an interlayer anion, $0<x<1$, n is a valence of A, and $0\leq m<1$). Note that examples of the bivalent metal ion $M^{2+}$ include $Mg^{2+}$, $Co^{2+}$, $Ni^{2+}$, $Zn^{2+}$, $Fe^{2+}$, $Ca^{2+}$, $Ba^{2+}$, $Cu^{2+}$, $Mn^{2+}$, and the like, examples of the trivalent metal ion $M^{3+}$ include $Al^{3+}$, $Fe^{3+}$, $Cr^{3+}$, $Ga^{3+}$, and the like, examples of the interlayer anion $A^{n-}$ include an n-valent anion such as $OH^-$, $Cl^-$, $CO_3^-$, and $SO_4^-$, and x is generally in a range of 0.2 to 0.33. Among the examples of the bivalent metal ion, $Mg^{2+}$, $Zn^{2+}$, $Fe^{2+}$, and $Mn^{2+}$ are preferable, and $Mg^{2+}$ is particularly preferable.

Hydrotalcite has a crystalline structure which is a laminated structure consisting of (i) a two-dimensional base layer in which brucite units each being a regular octahedron and having a positive charge are arranged and (ii) an intermediate layer having a negative charge.

Hydrotalcite is capable of exhibiting an anion exchange function in the composite fiber and thus exhibiting an excellent adsorption property. A magnesium-based hydrotalcite is particularly preferable for reasons such as ease in wastewater treatment, stability against heat, and suitability for use in paper due to having a high level of whiteness, as compared with other inorganic binders.

In an aspect of the present invention, a ratio of the inorganic binder in the composite fiber can be not less than 10% by mass, or not less than 20% by mass, or preferably, not less than 40% by mass in terms of ash content. The ash content of the composite fiber can be measured in accordance with JIS P 8251: 2003.

In a case where the inorganic binder is hydrotalcite, the composite fiber of the hydrotalcite, the titanium oxide, and the fiber contains magnesium, iron, manganese, or zinc in an amount of preferably not less than 10% by mass, more preferably not less than 20% by mass in the ash content. The content of the magnesium or the zinc in the ash content can be quantified by fluorescent X-ray analysis.

As one preferable aspect, an average primary diameter of the inorganic binder can be, for example, not more than 1 μm. Alternatively, it is possible to use an inorganic binder having an average primary particle diameter of not more than 500 nm, an inorganic binder having an average primary particle diameter of not more than 200 nm, an inorganic binder having an average primary particle diameter of not more than 100 nm, and an inorganic binder having an average primary particle diameter of not more than 50 nm. The inorganic binder may also have an average primary particle diameter of not less than 10 nm.

Note that "average primary particle diameter" as used herein is a value calculated on the basis of a photograph taken by a scanning electron microscope. Specifically, from an electron micrograph of particles, an area of an image of each particle is measured, and a diameter of a circle having the same area as the measured area is treated as a primary particle diameter of the each particle. An average primary particle diameter of particles is a diameter at 50% in a volume-based cumulative fraction, and is calculated as an average value of primary particle diameters of 100 or more randomly selected particle diameters. An average primary particle diameter can be calculated with use of a commercially available image analysis device.

Further, inorganic binders having various sizes and shapes can be complexed with fiber by adjusting the condition for synthesizing inorganic binders. For example, it is possible to provide a composite fiber in which fiber is complexed with a scale-shaped inorganic binder. A shape of an inorganic binder of the composite fiber can be checked by observing under an electron microscope.

The inorganic binder can be in the form of secondary particles which are aggregates of fine primary particles. The inorganic binder may be allowed to form secondary particles that are suited for the purpose of use by an aging process, or the aggregates may be broken into smaller pieces by pulverization. Examples of a method of pulverization include those using a ball mill, a sand grinder mill, an impact mill, a high-pressure homogenizer, a low-pressure homogenizer, Dinomill, an ultrasonic mill, Kanda grinder, an attritor, a stone mill, a vibrating mill, a cutter mill, a jet mill, a disintegrator, a beating machine, a short-screw extruder, a twin-screw extruder, an ultrasonic stirrer, a household juicer mixer, or the like.

[Fiber]

Fiber included in a titanium oxide composite fiber in accordance with an aspect of the present invention is preferably, for example, a cellulose fiber. Examples of the raw material of a cellulose fiber include pulp fiber (wood pulp, non-wood pulp), bacterial cellulose, animal-derived cellulose such as ascidian, and algae. Wood pulp can be produced by converting wood feedstock into pulp. Examples of the wood feedstock include (i) coniferous trees such as Japanese red pine, Japanese black pine, Sakhalin fir, Yezo spruce, *Pinus koraiensis*, Japanese larch, Japanese fir, Southern Japanese hemlock, Japanese cedar, Hinoki cypress, Japanese larch, *Abies veitchii*, spruce, Hinoki cypress leaf, Douglas fir, hemlock, white fir, spruce, Balsam fir, cedar, pine, Merkusii pine, and Radiata pine, and admixtures thereof; and (ii) broadleaf trees such as Japanese beech, birch, Japanese alder, oak, *Machilus thunbergii*, Castanopsis, Japanese white birch, Japanese aspen, poplar, Japanese ash, Japanese poplar, eucalyptus, mangrove, lauan, and acacia, and admixtures thereof.

A method for converting the natural material such as wood feedstock (woody raw material) into pulp is not particularly limited, and, for example, a pulping method commonly used in the paper industry can be employed. Wood pulp can be classified depending on the pulping method. Examples of the wood pulp include (i) chemical pulp digested by kraft method, sulfite method, soda method, polysulfide method, or the like, (ii) mechanical pulp obtained by pulping with mechanical force provided by a refiner, a grinder, or the like, (iii) semi-chemical pulp obtained by pulping with mechanical force after pretreatment with chemicals, (iv) wastepaper pulp, and (v) deinked pulp. The wood pulp can be unbleached (i.e., before bleaching) or bleached (i.e., after bleaching).

Examples of the non-wood pulp include cotton, hemp, sisal hemp, Manila hemp, flax, straw, bamboo, bagasse, kenaf, sugar cane, corn, rice straw, paper mulberry, paper bush, and the like.

The pulp fiber can be either unbeaten or beaten, and can be selected according to physical properties of the composite fiber. It is preferable that the pulp fiber is beaten. By the beating, it is possible to expect improvement in strength of the pulp fiber and promotion of fixing of titanium oxide and an inorganic binder to the pulp fiber. Moreover, in an aspect in which the composite fiber is in the form of a sheet, the beating of the pulp fiber makes it possible to expect improvement of a BET specific surface area of the composite fiber sheet. Note that a degree of beating of the pulp fiber can be represented by Canadian standard freeness (CSF) that is defined in JIS P 8121-2: 2012. As the beating proceeds, a drainage state of the pulp fiber is deteriorated, and freeness becomes lower.

Further, cellulose raw materials can also be further processed to be used as pulverized cellulose and chemically denatured cellulose such as oxidized cellulose.

Further, it is possible to employ various types of natural fibers, synthetic fibers, semi-synthetic fibers, and inorganic fibers, as well as the cellulose fiber. Examples of a natural fiber include, for example, a protein-based fiber such as wool fiber, silk fiber, and collagenous fiber; a complex sugar chain fiber such as chitin/chitosan fiber and algin fiber; and the like. Examples of a synthetic fiber include polyester, polyamide, polyolefin, and acrylic fiber, and the like. Examples of a semi-synthetic fiber include rayon, lyocell, acetate, and the like. Examples of an inorganic fiber include glass fiber, carbon fiber, any of various metal fibers, and the like.

A composite fiber composed of a synthetic fiber and a cellulose fiber can also be used in an aspect of the present invention. For example, it is possible to use a composite fiber composed of a cellulose fiber and polyester, polyamide, polyolefin, acrylic fiber, glass fiber, carbon fiber, any of various metal fibers, or the like.

Among those examples indicated above, the composite fiber preferably includes wood pulp or a combination of wood pulp and non-wood pulp and/or a synthetic fiber, more preferably includes wood pulp alone. In a preferable aspect, the fiber included in the composite fiber is pulp fiber.

The above exemplified fibers can be used alone or two or more types of those fibers can be used in combination.

The fiber to be complexed may have any fiber length. For example, the fiber to be complexed may have an average fiber length of approximately 0.1 μm to 15 mm. The average fiber length may alternatively be 10 μm to 12 mm, 50 μm to 10 mm, or 200 μm to 8 mm, for example. In the present invention, an average fiber length of more than 50 μm is preferable because it facilitates dehydration and sheet formation. An average fiber length of more than 200 μm is more preferable because it allows dehydration and sheet formation to be carried out with use of a mesh of wires (filter) for dehydration and/or paper-making used in an ordinarily paper-making process.

The fiber to be complexed may have any fiber diameter. For example, the fiber to be complexed may have an average fiber diameter of approximately 1 nm to 100 μm. The average fiber diameter may alternatively be 0.15 μm to 100 μm, 1 μm to 90 μm, 3 μm to 50 μm, or 5 μm to 30 μm, for example. In the present invention, an average fiber diameter of more than 500 nm is preferable because it facilitates water and sheet formation. An average fiber diameter of more than 1 μm is more preferable because it allows dehydration and sheet formation to be carried out with use of a mesh of wires (filter) for dehydration and/or paper-making used in an ordinarily paper-making process.

The amount of the fiber to be complexed is preferably an amount with which not less than 15% of the fiber surface is covered with the inorganic binder. For example, a mass ratio of the fiber and the inorganic binder is preferably 25/75 to 95/5, more preferably 30/70 to 90/10, and even more preferably 40/60 to 85/15.

[Fiber not Forming Composite]

Composite-fiber-containing slurry can contain fiber that does not form a composite. In a case where the composite-fiber-containing slurry contains the fiber that does not form a composite, it is possible to improve strength of an obtained sheet. The "fiber that does not form a composite" herein is intended to mean a fiber which is not complexed with the inorganic binder. The fiber that does not form a composite is not particularly limited, and can be selected as appropriate in accordance with a purpose. Examples of the fiber that does not form a composite include various types of natural fibers, synthetic fibers, semi-synthetic fibers, and inorganic fibers, as well as the above exemplified fibers. Examples of a natural fiber include, for example, a protein-based fiber such as wool fiber, silk fiber, and collagenous fiber; a complex sugar chain fiber such as chitin/chitosan fiber and algin fiber; and the like. Examples of a synthetic fiber include polyester, polyamide, polyolefin, and acrylic fiber, and the like. Examples of a semi-synthetic fiber include rayon, lyocell, acetate, and the like. Examples of an inorganic fiber include glass fiber, carbon fiber, any of various metal fibers, and the like.

A composite fiber composed of a synthetic fiber and a cellulose fiber can be used as the fiber that does not form a composite. For example, composite fibers composed of a cellulose fiber and polyester, polyamide, polyolefin, acrylic fiber, glass fiber, carbon fiber, any of various metal fibers, or the like can be used as the fiber that does not form a composite.

Among those examples indicated above, the fiber that does not form a composite preferably includes wood pulp or a combination of wood pulp and non-wood pulp and/or a synthetic fiber, more preferably includes wood pulp alone. Further, needle bleached kraft pulp is even more preferable because it has a long fiber length and is advantageous in improvement of strength.

A mass ratio of the composite fiber to the fiber that does not form a composite is preferably 10/90 to 100/0, and can be 20/80 to 90/10, or 30/70 to 80/20. As an amount of the composite fiber to be mixed increases, higher levels of whiteness and hiding power of the titanium oxide tend to be exhibited in an obtained sheet.

[Titanium Oxide]

Titanium oxide included in a titanium oxide composite fiber in accordance with an aspect of the present invention is present in fiber at a high fixation ratio and thereby enables the composite fiber to have high levels of whiteness and hiding property.

A ratio of the titanium oxide in the titanium oxide composite fiber can be not less than 5% by mass in terms of ash content, or not less than 40% by mass. For example, the ratio is 5% by mass to 30% by mass, preferably 15% by mass to 35% by mass. The higher the ratio of the titanium oxide in the composite fiber, the higher the levels of whiteness and hiding property exhibited by the composite fiber.

In the present invention, the titanium oxide can be a product that is commercially available for industrial or experimental use and has any level of purity. In terms of whiteness and hiding power, it is preferable to use a product containing not less than 20% by mass of titanium oxide, and more preferable to use a product containing not less than 30% by mass of titanium oxide. Examples of such a product include titanium monoxide (TiO), titanium dioxide ($TiO_2$), dititanium trioxide ($Ti_2O_3$), and the like, and titanium dioxide is particularly suitable. Further, the titanium oxide can be titanium oxide having any crystalline structure such as rutile-type, anatase-type, or brookite-type crystalline structure. Titanium oxide having a rutile-type crystalline structure, which is high in refractive index, is more preferable due to exhibiting a great hiding power even when used in a small amount. In particular, in a case where a composite fiber is molded into a sheet to be used as a base sheet for melamine decorative paper, it is preferable to use rutile-type titanium oxide because the rutile-type titanium oxide allows the base sheet to exhibit suitable levels of opacity and wet strength and have a high weather resistance. In a case of using anatase-type titanium oxide in the composite fiber, it is preferable to increase the wet strength of the sheet by making adjustment by selecting a certain type of fiber and/or using a commonly used additive such as a wet paper strengthening agent.

The titanium oxide has an average primary particle diameter of preferably 200 nm to 300 nm, more preferably 210 μm to 290 μm, and even more preferably 230 μm to 270 μm. In a case where the titanium oxide has an average primary particle diameter within this range, it is possible to obtain a composite fiber which can be molded into a sheet having high levels of whiteness and hiding property.

The titanium oxide may be surface-treated titanium oxide. Examples of a surface treatment agent include, but not limited to, silica, alumina, a metal oxide such as zinc oxide, and the like.

[Production of Titanium Oxide Composite Fiber]

A titanium oxide composite fiber can be produced by synthesizing a solid inorganic binder in slurry containing fiber and titanium oxide.

Synthesizing the inorganic binder in the slurry containing the fiber and the titanium oxide causes the solid inorganic binder to be firmly fixed to the fibers and also causes the titanium oxide to be firmly fixed to the inorganic binder. This enables producing a composite fiber which is a composite of the fiber, the inorganic binder, and the titanium oxide. By using this composite fiber, it is possible to obtain a titanium oxide composite fiber in which titanium oxide is efficiently fixed in fiber.

For example, in a case where the inorganic binder is hydrotalcite, a composite fiber of the hydrotalcite, titanium oxide, and fiber can be produced by synthesizing the hydrotalcite in a solution containing the fiber and the titanium oxide.

Synthesis of hydrotalcite can be carried out by a known method. For example, in a reactor vessel, fiber is immersed and suspended in (i) an aqueous carbonate solution containing carbonate ions that form an intermediate layer and (ii) an alkaline aqueous solution (such as sodium hydroxide) to form slurry. Then, titanium oxide is added to and dispersed in the resultant alkaline slurry. Then, to the alkaline slurry to which the titanium oxide has been added, an acid solution (which is an aqueous metal salt solution containing bivalent metal ions and trivalent metal ions which form a base layer) is added. Then, coprecipitation reaction is carried out while controlling a temperature, pH, and the like, and thus hydrotalcite is synthesized. In this way, when the hydrotalcite is formed on the fiber surface, the titanium oxide dispersed in the slurry is incorporated into or comes into close contact with the hydrotalcite. This makes it possible to cause the titanium oxide present in the slurry to be firmly fixed to the fiber in a uniform and efficient manner at a high ratio.

It is preferable that the pH of the slurry obtained by immersing and suspending the fiber be adjusted to fall in a range of 11 to 14, more preferably in a range of 12 to 13. In a case where the pH of the slurry is within the range, the titanium oxide subsequently added can be dispersed uniformly in the slurry.

As a source of bivalent metal ions that form the base layer, it is possible to use a chloride, sulfide, nitrate, or sulfate of magnesium, zinc, barium, calcium, iron, copper, silver, cobalt, nickel, or manganese. As a source of trivalent metal ions that form the base layer, it is possible to use a chloride, sulfide, nitrate, or sulfate of aluminum, iron, chromium, or gallium.

Further, in a case where, for example, the inorganic binder is any of other metal compounds, a composite fiber of the metal compound, titanium oxide, and fiber can be produced by similarly synthesizing the metal compound in a solution containing the fiber and the titanium oxide.

The method of synthesis of the metal compound is not particularly limited, and can be a well-known method. The method can be either a gas-liquid method or a liquid-liquid method. An example of the gas-liquid method is a carbon dioxide process in which, for example, magnesium carbonate can be synthesized by causing magnesium hydroxide to react with carbonic acid gas. Alternatively, calcium carbonate can be synthesized through a carbon dioxide process in which calcium hydroxide and carbonic acid gas are reacted with each other. Calcium carbonate may be synthesized by, for example, a soluble salt reaction method, a lime-soda method, or a soda method. Examples of the liquid-liquid method include a method in which an acid (such as hydrochloric acid or sulfuric acid) is caused to react with a base (such as sodium hydroxide or potassium hydroxide) by neutralization; a method in which an inorganic salt is caused to react with an acid or a base; or a method in which inorganic salts are caused to react with each other. Barium sulfate can be produced by, for example, causing barium hydroxide to react with sulfuric acid. Aluminum hydroxide can be produced by causing aluminum chloride or aluminum sulfate to react with sodium hydroxide. An inorganic binder in which calcium and aluminum are complexed can be produced by causing calcium carbonate to react with aluminum sulfate.

In synthesizing an inorganic binder in this manner, any additional metal or metal compound other than titanium oxide can coexist in a reaction liquid. In such a case, the metal or metal compound can be efficiently incorporated into and complexed with the inorganic binder.

In a case where two or more types of inorganic binders are complexed with fiber, it is possible that synthetic reaction of one type of inorganic binders is carried out in the presence of the fiber and titanium oxide, then the synthetic reaction is halted, and then another synthetic reaction of the other type of inorganic binders is carried out. Two or more types of inorganic binders can be simultaneously synthesized, provided that those types of inorganic binders do not obstruct each other's reactions, or two or more types of intended inorganic binders are synthesized by one reaction.

In production of the composite fiber, various known assistants can be further added. Such an additive can be added in an amount of preferably 0.001% by mass to 20% by mass, more preferably 0.1% by mass to 10% by mass, with respect to the inorganic binder.

In the present invention, a temperature of the synthetic reaction can be, for example, 30° C. to 100° C., and is preferably 40° C. to 80° C., more preferably 50° C. to 70° C., and particularly preferably approximately 60° C. An excessively high or low temperature tends to decrease reaction efficiency and increase cost.

Furthermore, the synthetic reaction can be controlled by adjusting a reaction time. Specifically, the synthetic reaction can be controlled by adjusting a residence time of a reactant in the reaction tank. Alternatively, according to the present invention, the reaction can be controlled by stirring the reaction liquid in the reaction tank or by carrying out a neutralization reaction in multiple stages.

A titanium oxide composite fiber in accordance with an aspect of the present invention finds various applications. Example applications include paper, fiber, nonwoven fabric, cellulosic composite materials, filter materials, paints, plastics and other resins, rubbers, elastomers, ceramics, glasses, metals, tires, building materials (such as asphalts, asbestos, cement, boards, concrete, bricks, tiles, plywood, and fiber boards), various carriers (such as catalytic carriers, pharmaceutical carriers, agrochemical carriers, and microbial carriers), wrinkle inhibitors, clays, abrasives, modifiers, repairing materials, heat insulating materials, dampproof materials, water-repellent materials, waterproof materials, light shielding materials, sealants, shielding materials, insect repellents, adhesive agents, inks, cosmetics, medical materials, paste materials, food additives, tablet excipients, dispersing agents, shape retaining agents, water retaining agents, filtration assistants, essential oil materials, oil processing agents, oil modifiers, radiowave absorptive materials, insulators, sound insulating materials, vibration proofing materials, semiconductor sealing materials, radiation-proof materials, hygiene products, cosmetics, fertilizers, feeds, perfumes, additives for paints, adhesive agents, and resins, discoloration inhibitor, electrically conductive materials, and heat-transferring materials. In addition, the titanium oxide composite fiber can be used in, for example, various types of filler and coating agents in the above described applications.

A titanium oxide composite fiber in accordance with an aspect of the present invention can be used in paper making applications. Paper including a titanium oxide composite fiber in accordance with an aspect of the present invention is also an aspect of the present invention. Examples of the paper include printing paper, newspaper, inkjet paper, PPC paper, kraft paper, fine paper, coated paper, fine coating paper, wrapping paper, tissue paper, colored fine paper, cast coated paper, noncarbon paper, label paper, thermal paper, various kinds of fancy paper, water-soluble paper, release paper, process paper, base sheet for wallpaper, base sheet for melamine decorative paper, incombustible paper, flame retardant paper, base sheet for laminated plate, printed electronics paper, battery separator, cushion paper, tracing paper, impregnated paper, ODP paper, building paper, decorative material paper, envelope paper, tape paper, heat exchanging paper, chemical fiber paper, sterilization paper, waterproof paper, oil-proof paper, heat-resistant paper, photocatalytic paper, cigarette paper, paperboard (such as linerboard, corrugating medium, and white paperboard), paper plate base sheet, paper cup base sheet, baking paper, sand paper, synthetic paper, and the like. Among these examples, a titanium oxide composite fiber in accordance with an aspect of the present invention can be particularly suitably used as base sheet for melamine decorative paper, as described later.

[Molding of Sheet]

With use of a titanium oxide composite fiber, it is possible to mold a sheet out of composite-fiber-containing slurry which contains the titanium oxide composite fiber. By molding a sheet with use of a titanium oxide composite fiber in accordance with an aspect of the present invention, a good retention of the titanium oxide to the sheet is achieved. Further, the obtained sheet has little difference in whiteness between a front side and a back side of the sheet, since the titanium oxide is allowed to uniformly mixed in the sheet.

The composite fiber sheet has a basis weight which can be adjusted as appropriate in accordance with a purpose. In a case where the composite fiber sheet is used as a base sheet for melamine decorative paper, the basis weight of the composite fiber sheet is, for example, 50 g/m$^2$ to 180 g/m$^2$, and may be preferably adjusted to 70 g/m$^2$ to 150 g/m$^2$.

Further, the sheet composed of the titanium oxide composite fiber may have a single-layer structure or a multilayer structure in which a plurality of layers are stacked on one another, in accordance with the purpose of use and the like. The layers of the multilayer structure may have the same composition or respective different compositions.

Examples of a paper machine used for sheet production include a Fourdrinier machine, a cylinder paper machine, a gap former, a hybrid former, a multilayer paper machine, a publicly known paper making machine in which paper making methods of those machines are combined, and the like.

Composite-fiber-containing slurry used in sheet molding can contain either (i) only one type of composite fibers or (ii) two or more types of composite fibers which are mixed together.

In sheet molding, it is possible to further add a substance, which is different from the composite fibers, to the composite-fiber-containing slurry to an extent that paper making is not disturbed. Examples of such an additive include a wet paper strength agent and/or a dry paper strength agent (paper strength enhancer). This makes it possible to improve strength of the composite fiber sheet. The paper strength agent can be, for example, resins such as urea formaldehyde resin, melamine formaldehyde resin, polyamide, polyamine, epichlorohydrin resin, vegetable gum, latex, polyethyleneimine, glyoxal, gum, mannogalactan polyethyleneimine, polyacrylamide resin, polyvinylamine, and polyvinyl alcohol; a composite polymer or a copolymer composed of two or more selected from those resins; starch and processed starch; carboxymethyl cellulose, guar gum, urea resin; and the like. An added amount of the paper strength agent is not particularly limited.

Other examples of the additives include, in accordance with a purpose, a freeness improver, an internal sizing agent, a pH adjuster, an anti-foaming agent, a pitch control agent, a slime control agent, a bulking agent, a filler such as calcium carbonate, kaoline, and talc, and the like. A used amount of each additive is not particularly limited.

[Base Sheet for Melamine Decorative Paper]

A sheet containing a titanium oxide composite fiber in accordance with an aspect of the present invention is suitably used for various applications in which high levels of whiteness and hiding property are expected. For example, a sheet containing a titanium oxide composite fiber in accordance with an aspect of the present invention can be particularly suitably used as a base sheet for melamine decorative paper.

The base sheet for melamine decorative paper is used as melamine decorative paper causing the base sheet to be impregnated with melamine resin. In production of a melamine decorative board, the melamine decorative paper is bonded, as a decorative layer, onto a core board such as a plywood board or a particle board, and a printed layer of a desired image is formed on the melamine decorative paper by gravure printing or the like, as necessary. The base sheet for melamine decorative paper is therefore required to have high levels of whiteness and hiding power in order to hide a base of the decorative board.

In a sheet containing a titanium oxide composite fiber in accordance with an aspect of the present invention, titanium oxide is fixed in fiber uniformly at a high ash yield. As such in a case where the sheet is used as melamine decorative paper, the sheet is able to exhibit an excellent level of whiteness and hide the base.

To produce melamine decorative paper from a sheet containing a titanium oxide composite fiber in accordance with an aspect of the present invention, a conventionally known production method can be used. Conditions such as an amount of melamine resin with which the sheet is impregnated can be adjusted as appropriate in accordance with the purpose of use.

Aspects of the present invention can also be expressed as follows:

The present invention encompasses but not limited to the following features:

(1) A titanium oxide composite fiber including: fiber; titanium oxide; and an inorganic binder, at least part of the inorganic binder containing at least one inorganic compound selected from (i) an inorganic salt containing at least one of: at least one metal selected from magnesium, barium, aluminum, copper, iron, and zinc; and silicic acid and (ii) metal particles containing the at least one metal, the inorganic binder being firmly fixed to the fiber, the titanium oxide being firmly fixed to the inorganic binder so that the titanium oxide is firmly fixed to the fiber via the inorganic binder.

(2) The titanium oxide composite fiber as set forth in (1), including: fiber; titanium oxide; and an inorganic binder, at least part of the inorganic binder containing an inorganic salt containing: at least one metal selected from magnesium, zinc, and barium; and aluminum.

(3) The titanium oxide composite fiber as set forth in (1) or (2), wherein the inorganic binder is hydrotalcite.

(4) The titanium oxide composite fiber as set forth in any one of (1) through (3), wherein the fiber is cellulose fiber.

(5) The titanium oxide composite fiber as set forth in any one of (1) through (4), wherein the fiber has a surface not less than 15% of which is covered with the inorganic binder.

(6) The titanium oxide composite fiber as set forth in any one of (1) through (5), wherein the titanium oxide is of rutile-type.

(7) The titanium oxide composite fiber as set forth in any one of (1) through (5), wherein the titanium oxide is of anatase-type.

(8) Paper containing a titanium oxide composite fiber recited in any one of (1) through (7).

(9) A base sheet for melamine decorative paper, containing a titanium oxide composite fiber recited in any one of (1) through (7).

(10) A method for producing a titanium oxide composite fiber recited in any one of (1) through (7), the method including the steps of: adding titanium oxide to slurry containing the fiber; and generating the titanium oxide composite fiber by synthesizing the inorganic binder in the slurry to which the titanium oxide has been added.

(11) A method for producing a titanium oxide composite fiber recited in any one of (1) through (7), the method including the steps of: forming slurry by suspending the fiber in an alkaline aqueous solution; adding titanium oxide to the slurry; and generating the titanium oxide composite fiber by synthesizing the inorganic binder in the slurry to which the titanium oxide has been added.

(12) The method as set forth in (11), wherein the alkaline aqueous solution has a pH of 11 to 14.

(13) A method for producing melamine decorative paper, the method including the step of impregnating, with melamine resin, a base sheet for melamine decorative paper recited in (9).

(14) A titanium oxide composite fiber, including: fiber; titanium oxide; and an inorganic binder, the inorganic binder being firmly fixed to the fiber, the titanium oxide being firmly fixed to the inorganic binder so that the titanium oxide is firmly fixed to the fiber via the inorganic binder, the inorganic binder being hydrotalcite.

(15) A method for producing a titanium oxide composite fiber, the titanium oxide composite fiber of a titanium oxide composite fiber including: fiber; titanium oxide; and an inorganic binder, the inorganic binder being firmly fixed to the fiber, the titanium oxide being firmly fixed to the inorganic binder so that the titanium oxide is firmly fixed to the fiber via the inorganic binder, the method including the steps of: adding titanium oxide to slurry containing the fiber; and generating the titanium oxide composite fiber by synthesizing the inorganic binder in the slurry to which the titanium oxide has been added.

The present invention is not limited to the embodiments, but can be altered by a skilled person in the art within the scope of the claims. The present invention also encompasses, in its technical scope, any embodiment derived by combining technical means disclosed in differing embodiments.

EXAMPLES

The present invention will be described below in more detail with reference to Examples. Note, however, that the present invention is not limited to such Examples. In addition, unless otherwise specified in this specification, concentrations, parts, and the like are based on the mass, and numerical ranges are described as including endpoints thereof.

Example 1

(1) Preparation of Alkaline Solution and Acid Solution

A solution for synthesizing hydrotalcite (HT) was prepared. As an alkaline solution (solution A), a mixed aqueous solution was prepared which contained $Na_2CO_3$ (Wako Pure Chemical Industries, Ltd.) and NaOH (Wako Pure Chemical Industries, Ltd.). As an acid solution (solution B), a mixed aqueous solution was prepared which contained $MgSO_4$ (Wako Pure Chemical Industries, Ltd.) and $Al_2(SO_4)_3$ (Wako Pure Chemical Industries, Ltd.)

Alkaline solution (solution A, $Na_2CO_3$ concentration: 0.05 M, NaOH concentration: 0.8 M)

Acid solution (solution B, $MgSO_4$ concentration: 0.3 M, $Al_2(SO_4)_3$ concentration: 0.1 M)

(2) Synthesis of Composite Fiber

As cellulosic fiber to be complexed, cellulose fiber was used. Specifically, pulp fiber was used which contained leaf bleached kraft pulp (LBKP, manufactured by Nippon Paper Industries, Co. Ltd.) and needle bleached kraft pulp (NBKP, manufactured by Nippon Paper Industries, Co. Ltd.) at a mass ratio of 8:2 (fiber length: 1.2 mm, fiber diameter: 25 μm) and in which a Canadian standard freeness was adjusted to 390 ml with use of a single disk refiner (SDR).

The pulp fiber was added to the alkaline solution, and thus an aqueous suspension (slurry) containing pulp fiber (pulp fiber concentration: 2.0%, pH: approximately 12.7) was prepared. The aqueous suspension (pulp solid content: 18.75 g) was put in a 2-L reactor vessel, and titanium oxide (rutile-type titanium oxide (IV), manufactured by Wako Pure Chemical Industries, Ltd.) was further added in an amount of 11.25 g (pulp solid content: 50% by mass, synthesized hydrotalcite: 20% by mass, titanium oxide: 30% by mass), and a resultant mixture was sufficiently stirred.

The acid solution was dropped to this aqueous suspension while stirring, with use of a device as illustrated in FIG. 1. Note that "A" in FIG. 1 is the aqueous suspension containing the pulp fiber and the titanium oxide, "B" is the acid solution, and "P" is a pump. A reaction temperature was 40° C., and a drip rate was 6 ml/min. The dripping was stopped when the pH of the reaction liquid reached approximately pH 8. After the dripping was finished, the reaction liquid was stirred for 30 minutes and washed with approximately 10 times as much water to remove salts. Thus, a composite fiber of titanium oxide particles, solid hydrotalcite ($Mg_6Al_2(OH)_{16}CO_3.4H_2O$), and pulp fiber was synthesized.

Figure 2:
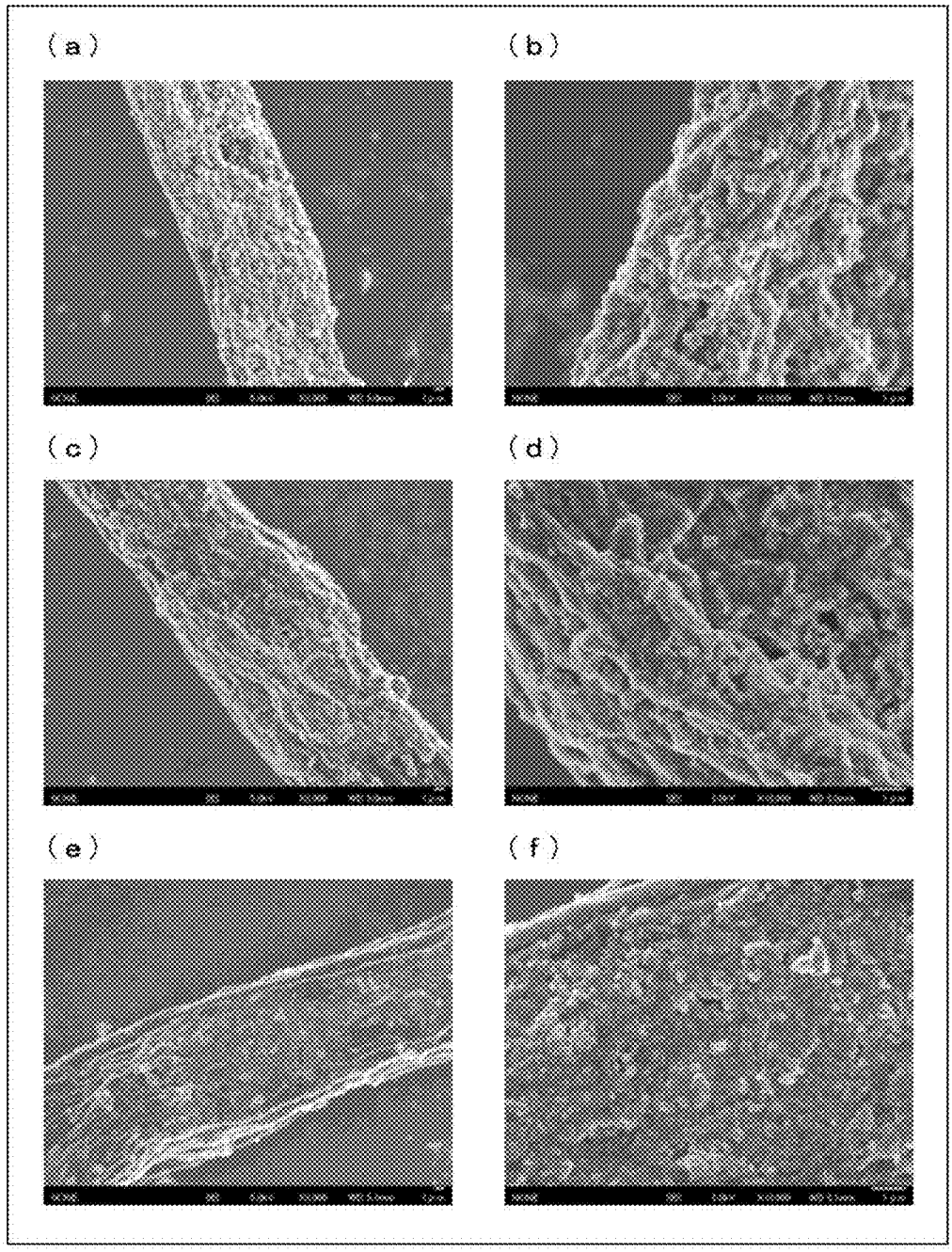
FIG. 2 shows views of results of observation, with use of a scanning electron microscope, of titanium oxide composite fibers produced in Examples 1 through 3. (a) of FIG. 2 is a view of a result of observation of the composite fiber of Example 1 at a magnification of 3000 times. (b) of FIG. 2 is a view of a result of observation of the composite fiber of Example 1 at a magnification of 10000 times. (c) of FIG. 2 is a view of a result of observation of the composite fiber of Example 2 at a magnification of 3000 times. (d) of FIG. 2 is a view of a result of observation of the composite fiber of Example 2 at a magnification of 10000 times. (e) of FIG. 2 is a view of a result of observation of the composite fiber of Example 3 at a magnification of 3000 times. (f) of FIG. 2 is a view of a result of observation of the composite fiber of Example 3 at a magnification of 10000 times.

Observation of a surface of the composite fiber in resultant slurry with use of a scanning electron microscope showed that not less than 15% of the fiber surface was covered with the solid hydrotalcite. An average primary particle diameter of the solid hydrotalcite was not more than 1 μm. Results are shown in (a) and (b) of FIG. 2. (a) of FIG. 2 is a view showing a result of observation of the composite fiber of Example 1 at a magnification of 3000 times. (b) of FIG. 2 is a view showing a result of observation of the composite fiber of Example 1 at a magnification of 10000 times.

(3) Preparation of Handmade Sheet

The obtained slurry of the composite fiber was diluted to prepare an aqueous suspension (pulp fiber concentration: 0.68%, pH: approximately 7.3). A handmade sheet having a basis weight of 100 g/m$^2$ was prepared with use of 150-mesh wires according to JIS P 8222: 1998.

Example 2

A composite fiber of titanium oxide particles, solid hydrotalcite ($Mg_6Al_2(OH)_{16}CO_3.4H_2O$), and pulp fiber was synthesized in the same manner as Example 1, except that 7.5 g of titanium oxide (pulp solid content: 60% by mass, synthesized hydrotalcite: 20% by mass, titanium oxide: 20% by mass) was added with respect to 22.5 g of a pulp solid content in the aqueous suspension.

Observation of a surface of the composite fiber in resultant slurry with use of a scanning electron microscope showed that not less than 15% of the fiber surface was covered with the solid hydrotalcite. An average primary particle diameter of the solid hydrotalcite was not more than 1 μm. Results are shown in (c) and (d) of FIG. 2. (c) of FIG. 2 is a view showing a result of observation of the composite fiber of Example 2 at a magnification of 3000 times. (d) of FIG. 2 is a view showing a result of observation of the composite fiber of Example 2 at a magnification of 10000 times.

Further, a handmade sheet having a basis weight of 100 g/m$^2$ was prepared from the obtained slurry of the composite fiber, in the same manner as Example 1.

Example 3

A composite fiber of titanium oxide particles, solid hydrotalcite ($Mg_6Al_2(OH)_{16}CO_3.4H_2O$), and pulp fiber was synthesized in the same manner as Example 1, except that 3.75 g of titanium oxide (pulp solid content: 70% by mass, synthesized hydrotalcite: 20% by mass, titanium oxide: 10% by mass) was added with respect to 26.25 g of a pulp solid content in the aqueous suspension.

Observation of a surface of the composite fiber in resultant slurry with use of a scanning electron microscope showed that not less than 15% of the fiber surface was covered with the solid hydrotalcite. An average primary particle diameter of the solid hydrotalcite was not more than 1 μm. Results are shown in (e) and (f) of FIG. 2. (e) of FIG. 2 is a view showing a result of observation of the composite fiber of Example 3 at a magnification of 5000 times. (f) of FIG. 2 is a view showing a result of observation of the composite fiber of Example 3 at a magnification of 10000 times.

Further, a handmade sheet having a basis weight of 100 g/m$^2$ was prepared from the obtained slurry of the composite fiber, in the same manner as Example 1.

Example 4

A composite fiber of titanium oxide particles, solid hydrotalcite ($Mg_6Al_2(OH)_{16}CO_3.4H_2O$), and pulp fiber was synthesized in the same manner as Example 1, except that 20.00 g of titanium oxide (pulp solid content: 60% by mass, synthesized hydrotalcite: 20% by mass, titanium oxide: 20% by mass), which was anatase-type titanium oxide (manufactured by Sakai Chemical Industry Co., Ltd.), was added with respect to 60.00 g of a pulp solid content in the aqueous suspension.

Figure 4:
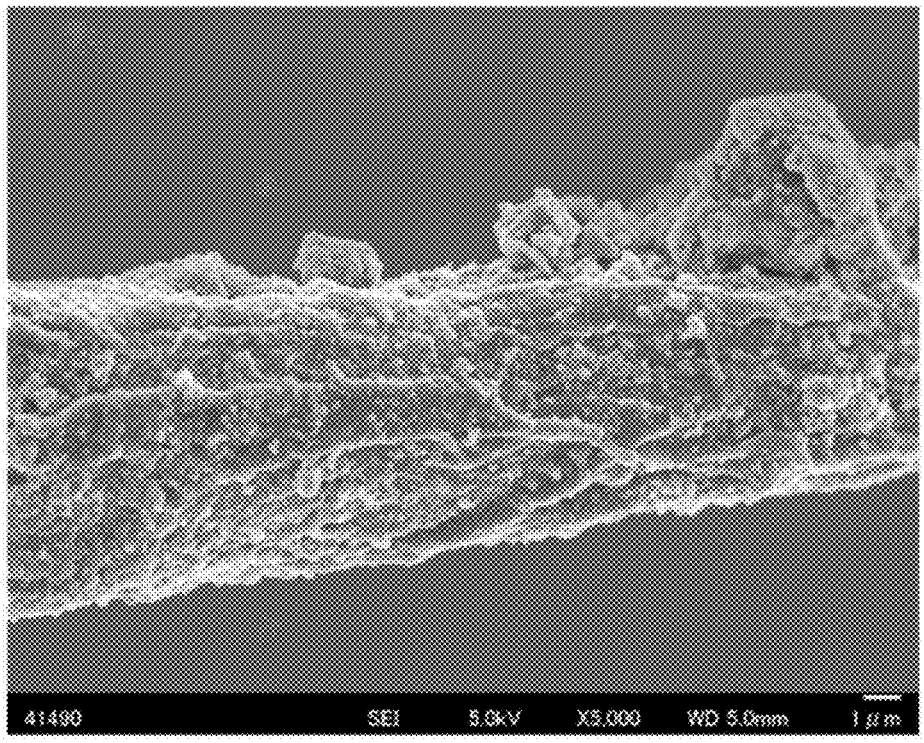
FIG. 4 shows views of results of observation, with use of a scanning electron microscope, of a titanium oxide composite fiber produced in Example 4. (a) of FIG. 4 is a view of a result of observation of the composite fiber of Example 4 at a magnification of 5000 times. (b) of FIG. 4 is a view of a result of observation of the composite fiber of Example 4 at a magnification of 10000 times.
Figure 4:
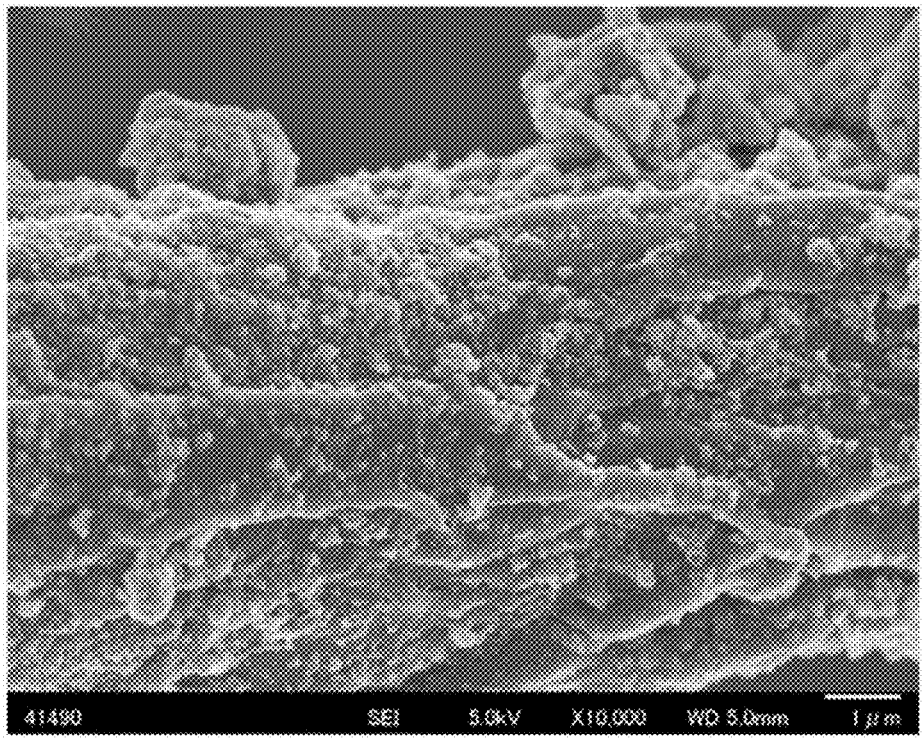

Observation of a surface of the composite fiber in resultant slurry with use of a scanning electron microscope showed that not less than 15% of the fiber surface was covered with the solid hydrotalcite. An average primary particle diameter of the solid hydrotalcite was approximately 200 nm. Results are shown in (a) and (b) of FIG. 4. (a) of FIG. 4 is a view showing a result of observation of the composite fiber of Example 4 at a magnification of 5000 times. (b) of FIG. 4 is a view showing a result of observation of the composite fiber of Example 4 at a magnification of 10000 times.

Further, a handmade sheet having a basis weight of 100 g/m$^2$ was prepared from the obtained slurry of the composite fiber, in the same manner as Example 1.

Example 5

Pulp fiber was added to a barium hydroxide solution (solid content: 14.7 g), and thus an aqueous suspension (slurry) containing pulp fiber (pulp fiber concentration: 2.0%, pH: approximately 12.8) was prepared. To the aqueous suspension (pulp solid content: 60.00 g), 20.00 g of titanium oxide (anatase-type titanium oxide manufactured by Sakai Chemical Industry Co., Ltd. (pulp solid content: 60% by mass, synthesized barium sulfate: 20% by mass, titanium oxide: 20% by mass)) was added, and a resultant mixture was sufficiently stirred.

Approximately 10 g of aluminum sulfate (concentration: 8% in terms of alumina) was dropped to this aqueous suspension while stirring, with use of a device as illustrated in FIG. 1. A reaction temperature was 30° C., and the dripping was stopped when the pH of the reaction liquid reached approximately pH 8. After the dripping was finished, the reaction liquid was stirred for 30 minutes. Thus, a composite fiber of titanium oxide particles, solid barium sulfate, and pulp fiber was synthesized.

Comparative Example 1

In a similar manner to Example 1, pulp fiber was added to an alkaline solution to prepare an aqueous suspension (pulp solid content: 26.25 g), 11.25 g of titanium oxide (pulp solid content: 70% by mass, titanium oxide: 30% by mass) was added to the aqueous suspension, and a resultant mixture was sufficiently suspended to prepare an aqueous suspension (pulp fiber concentration: 0.71%, pH: approximately 7.4). Further, a handmade sheet having a basis weight of 100 g/m$^2$ was prepared from resultant slurry.

Comparative Example 2

From the slurry of the pulp fiber (mass ratio of LBKP: NBKP=8:2, Canadian standard freeness: 390 ml) used in Examples 1 through 5, a handmade sheet having a basis weight of 100 g/m$^2$ was prepared in a similar manner to Example 1.

[Evaluation]

The handmade sheets obtained in Examples 1 through and Comparative Example 1 were subjected to measurement of ash content, titanium oxide content, basis weight, paper thickness, density, ash yield, whiteness of W side (back surface in contact with the wires) and F side (front surface) of the sheet, opacity, and specific scattering coefficient by the following method.

<Ash content> Calculated from a formula: "hydrotalcite content+(inorganic component−(hydrotalcite content×0.6))" in accordance with JIS P 8251: 2003. Note that "inorganic component" is a mass after the sheet is burned at 525° C. for 2 hours. Note that "0.6" is a mass reduction ratio in a case where hydrotalcite is burned at 525° C. for 2 hours.

<Titanium oxide content> Calculated from a formula: "ash content−hydrotalcite content".

<Basis weight> Measured in accordance with JIS P 8124: 1998.

<Paper thickness> Measured in accordance with JIS P 8118: 1998.

<Density> Calculated from measured values of paper thickness and basis weight.

<Ash yield> Calculated from (i) a total amount of titanium oxide and hydrotalcite in the formulation and (ii) a measured value of ash content.

<Whiteness> Measured in accordance with JIS P 8212: 1998.

<Opacity> Measured in accordance with JIS P 8149: 2000.

<Specific scattering coefficient (S value)> Calculated in accordance with a formula defined in TAPPI T425 (ISO 9416).

Results are shown in Tables 1 and 2 below.

TABLE 1

| | | Ex. 1 | Ex. 2 | Ex. 3 | Comp. Ex. 1 |
|---|---|---|---|---|---|
| Formulation | Pulp [wt %] | 50 | 60 | 70 | 70 |
| | Titanium oxide [wt %] | 30 | 20 | 10 | 30 |
| | Hydrotalcite [wt %] | 20 | 20 | 20 | 0 |
| Actual measured value | Ash content [wt %] | 48.4 | 40.7 | 30.1 | 24.8 |
| | Titanium oxide [wt %] | 28.4 | 20.7 | 10.1 | 24.8 |
| | Basis weight [g/m$^2$] | 101.2 | 104.4 | 104.1 | 97.5 |
| | Paper thickness [μm] | 140 | 157 | 158 | 173 |
| | Density [g/cm$^3$] | 0.72 | 0.66 | 0.66 | 0.56 |
| | Ash yield [%] | 96.8 | 101.8 | 100.3 | 82.7 |
| | Whiteness on W side [%] | 92.8 | 92.1 | 89.8 | 89.1 |
| | Whiteness on F side [%] | 92.7 | 92.1 | 89.7 | 88.9 |
| | Opacity [%] | 96.8 | 96.3 | 93.1 | 92.9 |
| | Specific scattering coefficient S [m$^2$/kg] | 144 | 123 | 73 | 73 |

TABLE 2

| | | Ex. 4 | Ex. 5 | Comp. Ex. 2 |
|---|---|---|---|---|
| Formulation | Pulp [wt %] | 60 | 60 | 100 |
| | Titanium oxide [wt %] | 20 | 20 | 0 |
| | Hydrotalcite [wt %] | 20 | 0 | 0 |
| | Barium sulfate [wt %] | 0 | 20 | 0 |
| Actual measured value | Ash content [wt %] | 40.0 | 39.6 | 0.5 |
| | Titanium oxide [wt %] | 20.0 | 19.6 | 0.0 |
| | Basis weight [g/m$^2$] | 103.6 | 104.7 | 108.6 |
| | Paper thickness [μm] | 164 | 72 | 157 |
| | Density [g/cm$^3$] | 0.63 | 0.61 | 0.69 |
| | Ash yield [%] | 100.0 | 99.0 | — |
| | Whiteness on W side [%] | 90.5 | 90.1 | 84.5 |
| | Whiteness on F side [%] | 90.3 | 89.8 | 84.6 |
| | Opacity [%] | 94.0 | 93.4 | 76.0 |
| | Specific scattering coefficient S [m$^2$/kg] | 82 | 75 | 22 |

In each of the sheets respectively containing the composite fibers of Examples 1 to 5, the titanium oxide was fixed in the fiber uniformly with a high ash yield. This is because each of these sheets contained hydrotalcite or barium sulfate as the inorganic binder. Further, it was confirmed that the whiteness, the opacity, and the specific scattering coefficient improved in accordance with an amount of the titanium oxide which was mixed.

In contrast, the sheet of Comparative Example 1 had a low fixation ratio of the titanium oxide. The sheet also had uneven whiteness, and a whiteness on the W side was significantly different from that on the F side.

[Preparation of Melamine Decorative Paper]

Figure 3:
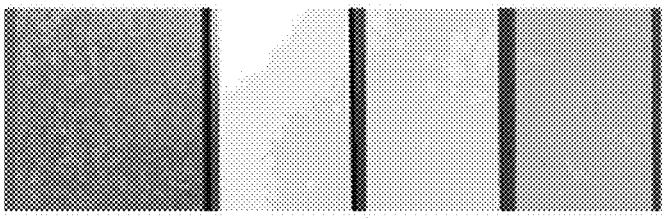
FIG. 3 is a view of results of visual observation of melamine decorative paper obtained by impregnating, with melamine resin, a base sheet for melamine decorative paper containing respective composite fibers prepared in Examples 1 and 2 and Comparative Example 1 (from left to right, a product in which no titanium oxide was mixed, Example 1, Example 2, and Comparative Example 1 in this order).

The sheets containing the composite fibers prepared in Examples 1 and 2 and Comparative Example 1 were each impregnated with melamine resin to prepare melamine decorative paper. The melamine decorative paper obtained was bonded onto a surface of a core board, and an appearance of a resultant board was observed by visual observation. Results are shown in FIG. 3. FIG. 3 shows, from left to right, a product in which no titanium oxide was mixed, Example 1, Example 2, and Comparative Example 1 in this order.

The melamine decorative paper composed of the sheet of Example 1 and the melamine decorative paper composed of the sheet of Example 2 each exhibited a hiding power better than that of Comparative Example 1.

[Evaluation of Photocatalytic Deodorizing Property]

With use of the sheets produced in Example 4, Example 5, and Comparative Example 2 (basis weight: approximately 100 g/m$^2$), evaluation of a photocatalytic deodorizing property was conducted. A deodorizing test was carried out based on a method of the certification standards of SEK mark textile products (JEC301, Japan Textile Evaluation Technology Council). The composite fiber sheets subjected to the test were each in a size of 100 cm$^2$ (10 cm×10 cm).

A test sample was put in a 5-L tedlar-bag plastic bag, and 3 L of gas (gas component: ammonia or acetaldehyde) adjusted to a predetermined concentration was injected into the bag to conduct a first exposure test for 24 hours. A residual gas concentration after the exposure test was measured with use of a detecting tube. At this time, in a case where (i) either a reduction ratio under light conditions or a reduction ratio under dark conditions was above 70 and (ii) a photocatalytic effect was below 20, a second exposure test was conducted with use of the sample which has been subjected to the first exposure test.

[Methods for Calculating Odor Component Reduction Ratio and Photocatalytic Effect]

Methods for calculating a reduction ratio of an odor component to be tested and a photocatalytic effect are shown below.

Odor Reduction Ratios

Reduction ratio under light conditions (%): $R_L=(L_0-L_1)/L_0\times100$

Reduction ratio under dark conditions (%): $R_B=(B_0-B_1)/B_0\times100$

Photocatalytic effect (point): $V=R_L-R_B$ $L_0$: A concentration of an odor component in a test (blank test) conducted under light conditions without use of a sample $L_1$: A concentration of an odor component in a test conducted under light conditions with use of a sample $B_0$: A concentration of an odor component in a test (blank test) conducted under dark conditions without use of a sample $B_1$: A concentration of an odor component in a test conducted under dark conditions with use of a sample

[Evaluation Criteria Regarding Odor Component Reduction Ratio and Photocatalytic Effect]

Table 3 shows evaluation criteria regarding an odor component reduction ratio of an odor component to be tested and a photocatalytic effect. It is necessary that both an odor component reduction ratio of an odor component to be tested and a difference in odor component reduction ratio made by a photocatalytic effect meet the evaluation criteria.

TABLE 3

| Evaluation criteria for evaluation items | Evaluation criteria |
|---|---|
| Odor component reduction ratio of odor component to be tested after first exposure test (%) | $R_L \geq 70$ or $R_B \geq 70$ *1 |
| Difference in odor component reduction ratio made by photocatalytic effect $V = R_L - R_B$ (point) | $V_1 \geq 20$ or $V_2 \geq 20$ |

$V_1$: A value obtained by the first exposure test $V_2$: A value obtained by the second exposure test

*1: One of $R_L$ value and $R_B$ value which one is greater than the other is adopted (generally, $R_L$).

Table 4 shows, with respect to the sheets of Examples 4 and 5 and Comparative Example 2, an odor component reduction ratio and a photocatalytic effect calculated from the odor component reduction ratio.

What is claimed is:

1. A titanium oxide composite fiber comprising:

fiber;

titanium oxide; and an inorganic binder, the inorganic binder being firmly fixed to the fiber, the titanium oxide being firmly fixed to the inorganic binder so that the titanium oxide is firmly fixed to the fiber via the inorganic binder, the inorganic binder being hydrotalcite, at least part of the inorganic binder containing at least one inorganic compound selected from (i) an inorganic salt containing at least one of: at least one metal selected from magnesium, barium, copper, iron, and zinc and (ii) metal particles containing the at least one metal.

2. The titanium oxide composite fiber as set forth in claim 1, wherein the fiber is cellulose fiber.

3. The titanium oxide composite fiber as set forth in claim 1, wherein the fiber has a surface not less than 15% of which is covered with the inorganic binder.

4. Paper comprising a titanium oxide composite fiber recited in claim 1.

5. A method for producing a titanium oxide composite fiber, the titanium oxide composite fiber including:

fiber;

titanium oxide; and an inorganic binder, the inorganic binder being firmly fixed to the fiber, the titanium oxide being firmly fixed to the inorganic binder so that the titanium oxide is firmly fixed to the fiber via the inorganic binder, the method comprising the steps of:

adding titanium oxide to slurry containing the fiber; and generating the titanium oxide composite fiber by synthesizing the inorganic binder in the slurry to which the titanium oxide has been added,

TABLE 4

| | | | Ex. 4 | | Ex. 5 | | Comp. Ex. 2 | |
|---|---|---|---|---|---|---|---|---|
| Formulation | Pulp [wt %] | | 60 | | 60 | | 100 | |
| | Titanium oxide [wt %] | | 20 | | 20 | | 0 | |
| | Hydrotalcite [wt %] | | 20 | | 0 | | 0 | |
| | Barium sulfate [wt %] | | 0 | | 20 | | 0 | |
| | | | $R_L$: light conditions | $R_B$: dark conditions | $R_L$: light conditions | $R_B$: dark conditions | $R_L$: light conditions | $R_B$: dark conditions |
| Odor component reduction ratio (%) | Ammonia | 1st exposure | ≥99 | 86 | ≥99 | 83 | 78 | 73 |
| | | 2nd exposure | ≥99 | 69 | ≥99 | 56 | 40 | 27 |
| | Acetaldehyde | 1st exposure | 99 | 31 | 99 | 29 | 0 | 0 |
| Photocatalytic effect (light conditions - dark conditions) | Ammonia | $V_1$: 1st exposure | 13 | | 16 | | 5 | |
| | | $V_2$: 2nd exposure | 30 | | 43 | | 3 | |
| | Acetaldehyde | $V_1$: 1st exposure | 68 | | 70 | | 0 | |

As clear from Table 4, it was revealed that the sheets of Examples 4 and 5 each had a photocatalytic deodorizing property.

INDUSTRIAL APPLICABILITY

An aspect of the present invention is suitably applicable to the paper manufacturing field.

at least part of the inorganic binder containing at least one inorganic compound selected from (i) an inorganic salt containing at least one of: at least one metal selected from magnesium, barium, aluminum, copper, iron, and zinc; and silicic acid and (ii) metal particles containing the at least one metal.

6. A method for producing a titanium oxide composite fiber recited in claim 5, the method comprising the steps of:

forming slurry by suspending the fiber in an alkaline aqueous solution;

adding titanium oxide to the slurry; and generating the titanium oxide composite fiber by synthesizing the inorganic binder in the slurry to which the titanium oxide has been added.

7. The method as set forth in claim 6, wherein the alkaline aqueous solution has a pH of 11 to 14.

8. A base sheet for melamine decorative paper, comprising a titanium oxide composite fiber recited in claim 1.

9. A method for producing a titanium oxide composite fiber recited in claim 1, the method comprising the steps of:

adding titanium oxide to slurry containing the fiber, and generating the titanium oxide composite fiber by synthesizing the inorganic binder in the slurry to which the titanium oxide has been added, the inorganic binder being hydrotalcite, at least part of the inorganic binder containing an inorganic salt containing: at least one metal selected from magnesium, zinc, barium and aluminum.

10. A method for producing melamine decorative paper, the method comprising the step of impregnating, with melamine resin, a base sheet for melamine decorative paper, the base sheet comprising a titanium oxide composite fiber recited in claim 1.

11. The A titanium oxide composite fiber as set forth in claim 1, comprising:

fiber;

titanium oxide; and an inorganic binder, the inorganic binder being firmly fixed to the fiber, the titanium oxide being firmly fixed to the inorganic binder so that the titanium oxide is firmly fixed to the fiber via the inorganic binder, the inorganic binder being hydrotalcite, at least part of the inorganic binder containing an inorganic salt containing: at least one metal selected from magnesium, zinc, and barium; and aluminum.

12. The titanium oxide composite fiber as set forth in claim 11, wherein the fiber is cellulose fiber.

13. The titanium oxide composite fiber as set forth in claim 11, wherein the fiber has a surface not less than 15% of which is covered with the inorganic binder.

14. Paper comprising a titanium oxide composite fiber recited in claim 11.

15. A base sheet for melamine decorative paper, comprising a titanium oxide composite fiber recited in claim 11.

16. A method for producing a titanium oxide composite fiber recited in claim 11, the method comprising the steps of:

adding titanium oxide to slurry containing the fiber, and generating the titanium oxide composite fiber by synthesizing the inorganic binder in the slurry to which the titanium oxide has been added, the inorganic binder being hydrotalcite, at least part of the inorganic binder containing an inorganic salt containing: at least one metal selected from magnesium, zinc, barium and aluminum.

17. A method for producing melamine decorative paper, the method comprising the step of impregnating, with melamine resin, a base sheet for melamine decorative paper, the base sheet comprising a titanium oxide composite fiber recited in claim 11.

* * * * *